US005663535A

United States Patent [19]

MacDonald et al.

[11] Patent Number: 5,663,535

[45] Date of Patent: Sep. 2, 1997

[54] SOUND ATTENUATOR FOR HVAC SYSTEMS

[75] Inventors: Michael S. MacDonald, Madison; Thinakorn Assarattanakul, Verona, both of Wis.

[73] Assignee: Venturedyne, Ltd., Milwaukee, Wis.

[21] Appl. No.: 520,214

[22] Filed: Aug. 28, 1995

[51] Int. Cl.[6] ..... E04F 17/04

[52] U.S. Cl. ..... 181/224; 181/255; 181/256; 181/272

[58] Field of Search ..... 181/224, 225, 181/229, 255, 256, 252, 264, 269, 272, 273, 276, 282; 415/223

[56] References Cited

U.S. PATENT DOCUMENTS

| | | | |
|---|---|---|---|
| Re. 31,275 | 6/1983 | Wirt . | |
| 2,308,886 | 1/1943 | Mason . | |
| 2,974,745 | 3/1961 | Kristiansen . | |
| 3,033,307 | 5/1962 | Sanders et al. . | |
| 3,511,336 | 5/1970 | Rink et al. . | |
| 3,554,111 | 1/1971 | Traver et al. . | |
| 3,557,903 | 1/1971 | Straw | 181/255 |
| 4,109,750 | 8/1978 | Wirt . | |
| 4,111,278 | 9/1978 | Bergman | 181/255 X |
| 4,236,597 | 12/1980 | Kiss et al. . | |
| 4,287,962 | 9/1981 | Ingard et al. . | |
| 4,298,088 | 11/1981 | Keller et al. . | |
| 4,316,522 | 2/1982 | Hirschorn . | |
| 4,371,054 | 2/1983 | Wirt | 181/255 X |
| 4,432,434 | 2/1984 | Dean, Jr. | 181/225 |
| 4,787,473 | 11/1988 | Fuchs . | |
| 4,872,398 | 10/1989 | Shen et al. . | |
| 4,986,170 | 1/1991 | Ramakrishnan et al. . | |
| 5,066,194 | 11/1991 | Amr et al. | 415/223 |
| 5,215,437 | 6/1993 | Tevelde et al. | 415/223 |
| 5,285,026 | 2/1994 | Lemetyinen | 181/224 |

*Primary Examiner*—Khanh Dang

*Attorney, Agent, or Firm*—Jansson & Shupe, Ltd.

[57] ABSTRACT

An apparatus for attenuating sound in a HVAC system has an inlet mouth aria a tube downstream of the inlet mouth. In the improvement, the inlet mouth defines a surface of revolution formed by rotating a segment of an ellipse about the long axis aria at a fixed distance therefrom. The new apparatus has an air flow transition chamber which permits air flow to "normalize" after air enters the apparatus at its inlet end but before such air enters the inlet mouth. The apparatus also has a baffle between the entry portion and the apparatus outlet end and positioned to occlude the enclosed cavity between the interior tube and the outer housing. The apparatus thereby more effectively attenuates sound in the third octave band. Optionally, the apparatus (either alone or in combination with a VAV terminal unit) has exterior insulation for preventing moisture condensation and further reducing objectionable sound.

22 Claims, 6 Drawing Sheets

SOUND ATTENUATOR FOR HVAC SYSTEMS

FIELD OF THE INVENTION

This invention relates generally to acoustics and, more particularly, to sound reduction in heating, ventilating and air conditioning (HVAC) systems.

BACKGROUND OF THE INVENTION

Heating, ventilating and air conditioning (HVAC) systems are in wide use for providing clean, comfortable working environments in buildings such as offices, schools and the like. Such systems "condition" air by regulating air temperature and relative humidity and, usually, by removing very small airborne particulates therefrom. Such systems use air from the outdoor ambient, from within the building (i.e., re-circulated air) or a system may use a combination of fresh and re-circulated air.

To regulate air temperature or humidity or to filter out airborne particulates, it is necessary that the air be moved across or through, e.g., cooling coils, heating units, filters and water vapor injectors or evaporators, the latter for increasing relative humidity. Primary air movement is usually effected by what is known as an air handling unit.

A large system for, say, a multi-story office building may have a number of air handling units, each of which may be as large as 10 feet or so in length, width and height. Each air handling unit is equipped with a very large blower not unlike (except as to size) a common household fan. Such blower has a fan blade driven by an electric motor.

Air forced from an air handling unit by such blower is directed along one or a few air ducts, the cross-sectional area(s) of which are relatively large. Such ducts are usually made of sheet metal and each duct is branched into two or more smaller ducts. Each of such smaller ducts is terminated (in the acoustical-tile ceiling of an individual room or small group of rooms, for example) by a diffuser. As its name suggests, a diffuser directs the conditioned air in different directions so that the flow of air will not be sensed or will scarcely be sensed by persons occupying the room(s).

In more modern systems, a variable air volume (VAV) terminal unit may be interposed between the duct and the diffuser. In such a terminal unit, the volume of air urged through the diffuser over a given length of time is controlled. VAV terminal units permit "personalizing" the temperature of a particular room or group of rooms to the likes of the occupants. U.S. Pat. No. 5,180,102 (Gilbert et al.) includes a general description of a HVAC system and U.S. Pat. No. 4,418,719 (Downs, Jr. et al.) describes a type of VAV terminal unit.

In conventional practice, a VAV terminal unit has a circular inlet collar mating with and connected to a run of duct from an air handling unit. A rectangular outlet end couples such terminal unit to a diffuser.

While there may be several sources of objectionable sound (i.e., "noise") in a HVAC system, at least every component of rotating machinery, e.g., the blower of an air handling unit, generates sound waves which propagate along the duct through the air flowing in the duct. And certain types of VAV terminal units include integral motor-driven fans. Unless attenuated to acceptable levels, the propagated sound waves are evident (and they may be very evident) to persons in the rooms served by the HVAC system.

Efforts to reduce or eliminate sound waves in air ducts are ongoing. Noise attenuators and silencers are described in U.S. Pat. Nos. 2,308,886 (Mason); 2,974,475 (Kristiansen); 3,033,307 (Sanders et al.); 3,511,336 (Rink et al.) and 4,287,962 (Ingard et al.).

(The apparatus of the Sanders et al. and Rink et al. patents are of a type known as "dissipative" devices since they rely at least in part upon sound absorptive material—"packing"—to attenuate sound. The apparatus of the Ingard et al. patent is of a type known as a "reactive" device which attenuates noise without using packing.)

The Rink et al. patent discloses a sound attenuator, the converging section of which is formed by two opposed curved panels. The resulting opening is rectangular when viewed in a plane normal to the long axis of the attenuator. And such attenuator has what the patent calls absorption chambers packed with an acoustical fill material. The flat diverging surfaces have holes that are 0.125 inches diameter and such holes are said to constitute less than 14% of the surface area.

The Ingard et al. patent discloses a packless silencer having a pair of opposed curved entry panels which are said to have a "semi-elliptical" shape. The resulting air entry port is rectangular and slot-like when viewed in a plane normal to the long axis of the silencer. The holes in the parallel flat panels are of uniform diameter for a particular thickness of sheet metal. Such diameters range from 0.032 to 0.188 inches diameter and a preferred percentage of the aggregate area of the holes to the total surface area is said to be in the range of 2.5 to 10%.

(Strictly speaking, the term "silencer" may somewhat overstate the capability of a device for reducing sound in a HVAC system. However, such term is widely used in the HVAC industry and is generally understood to mean a device which reduces sound to an acceptable level, perhaps even to a level imperceptible to most persons.)

At least in HVAC systems, sound attenuation is often determined by measuring sound power reduction in any one, some or all of eight octave bands which are described in more detail below. Such octave bands are used in the industry because they represent frequencies to which human hearing is most sensitive.

When a noise attentuator or silencer is used with a VAV terminal unit, conventional practice is to interpose a straight length of what might be termed "flow-normalizing" duct between the attenuator and the terminal unit. Such length of duct permits air flow (which is or may be disturbed by mere presence of the terminal unit or by its damper-like throttling valve) to re-establish a uniform velocity profile.

Traditional practice dictates that for air flow rates of 2500 feet per minute or less, the interposed straight length of duct should have a length at least 2.5 times the diameter of the duct feeding the VAV terminal unit in order to re-establish a uniform velocity profile. And it has been found that spacing the VAV terminal unit and an attentuator by a duct of such length reduces the sound level.

While prior art approaches to configuring and using noise attenuators have been generally satisfactory, they are not without some problems. For example, sound-deadening packing as described in the Rink et al. and Sanders et al. patents is troublesome to handle in the factory and install during manufacture. And in view of the invention, its presence makes the attentuator heavier and more unwieldly to mount than is otherwise necessary.

Another disadvantage of prior art practice involves the length of flow-normalizing intermediate duct placed between a VAV terminal unit and an attenuator. With such duct, the aggregate length of the VAV terminal unit, intermediate duct and attenuator is rather great.

An improved attentuator which addresses and overcomes some of the problems of prior art practice would be an important advance in the art.

OBJECTS OF THE INVENTION

It is an object of the invention to provide an improved sound attenuator overcoming some of the problems and shortcomings of the prior art.

Another object of the invention is to provide an improved sound attenuator for use in HVAC systems.

Yet another object of the invention is to provide an improved attenuator which is effective in reducing sound levels in HVAC systems.

Another object of the invention is to provide an improved attenuator exhibiting diminished pressure drop and, therefore, diminished "insertion loss."

Another object of the invention is to provide an improved sound attenuator which substantially eliminates the need for a flow-normalizing duct between a VAV terminal unit and the attenuator.

Still another object of the invention is to provide an improved sound attenuator which may be coupled directly to a VAV terminal unit.

Another object of the invention is to provide an improved reactive sound attenuator, i.e., an attenuator which is free of packing such as insulating material or the like.

Another object of the invention is to provide an improved sound attenuator having special provisions for reducing sound level in the third octave band. How these and other objects are accomplished will become apparent from the following descriptions and from the drawings.

SUMMARY OF THE INVENTION

Aspects of the invention involve an improvement in an apparatus for attenuating sound in a HVAC system. Such apparatus has an inlet mouth and a generally-cylindrical tube downstream of the inlet mouth and having a long axis. In the improvement, the inlet mouth defines a surface of revolution formed by rotating a segment of an ellipse about the long axis and at a fixed distance therefrom. In a highly preferred embodiment, the segment is substantially a quadrant of an ellipse.

In a highly preferred embodiment, the new apparatus has an air flow transition chamber permitting air flow to "normalize," i.e., to establish a substantially uniform velocity "profile" after air enters the apparatus at its inlet end but before such air enters the inlet mouth. The transition chamber is between the inlet end and the inlet mouth, is adjacent to the entry portion of such mouth and has a cross-sectional area that is greater than the cross-sectional area of the entry portion.

And in one specific embodiment, the cross-sectional area of the transition chamber is substantially rectangular. (It will be recalled that a rectangle is a parallelogram, all angles of which are right angles.)

In highly preferred embodiments of the invention, the ratio of the length of the "box-like" air flow transition chamber (measured parallel to the long axis of the apparatus tube) to the diameter of such tube is in the range of 0.40 to 1.25. This is well less than the ratio of 2.5 suggested by traditional practice.

In another aspect of the invention, the apparatus includes a baffle between the entry portion and the apparatus outlet end. Preferably, the baffle is about midway between the entry portion and the outlet end and by including such baffle, the apparatus thereby more effectively attenuates sound in the third octave band.

In yet another aspect of the invention, the apparatus has an outer housing extending from the entry portion to the outlet end. The housing and the air flow tube (located downstream of the inlet mouth) have an elongate cavity between them. The cavity is substantially free of "packing," e.g., fiberglass insulating material, and the baffle substantially entirely occludes such cavity for most effective third-octave-band sound attenuation. In preferred embodiments, the ratio of the volume of the flow passage (that passage defined by the transition chamber, the elliptical inlet mouth and the tube) to the volume of the cavity is less than 1.0. In highly preferred embodiments, such ratio is in the range of 0.75 to 0.85.

As one of its optional features, the exterior surfaces of the housing, e.g., those generally parallel to the tube long axis, are substantially covered by insulation. In operating environments where moisture condensation may be a problem, such insulation substantially avoids condensation of moisture on the exterior surfaces.

When used in combination with a VAV terminal unit (or throttling unit, as they are sometimes called), the outlet end of such unit is coupled to the inlet end of the apparatus and flows air into such apparatus. The terminal unit also has exterior surfaces, major portions of which are covered by insulation. In such combination, the apparatus attenuates sound propagated in the air flowing from the unit and the insulation helps avoid moisture condensation on both the terminal unit and the apparatus.

Other details of the invention are set forth in the following detailed description and in the drawings.

DETAILED DESCRIPTION OF PREFERRED EMBODIMENTS

Figure 1:
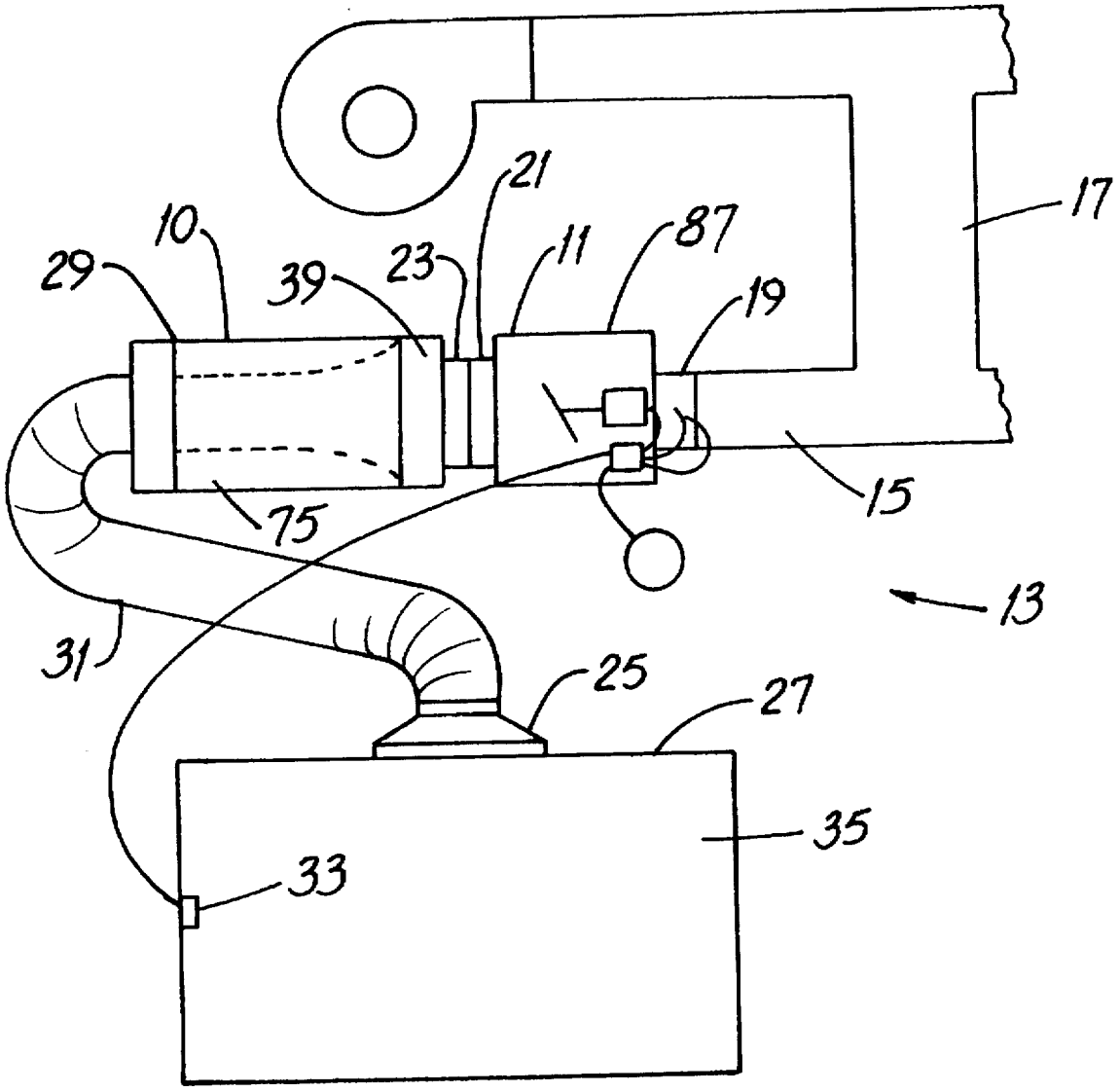
FIG. 1 is a representative side elevation view of an exemplary heating, ventilating and air conditioning (HVAC) system.

Before describing the inventive sound attenuator apparatus 10, it will be helpful to have an understanding of how such attentuator 10 may be used in conjunction with a VAV terminal unit 11 in a heating, ventilating and air conditioning system 13. As shown in FIG. 1, an exemplary VAV terminal unit 11 has forced air flowing to it from one leg 15 of a multi-leg air duct 17. The leg 15 is connected to the unit inlet collar 19.

The outlet end 21 of the unit 11 is connected to and in air flow communication with the inlet end 23 of the attenuator 10. A diffuser 25 is mounted flush with a dropped ceiling 27 and is connected to the outlet end 29 of the attenuator 10 by a flexible tube 31. By controlling the terminal unit 11 in a known way including by using a thermostat 33, the volume of air per unit of time that is exhausted from the diffuser 25 and the temperature of such air (and thus the temperature in the room 35) can be controlled. Details of the new attenuator 10 are described below.

Figure 2:
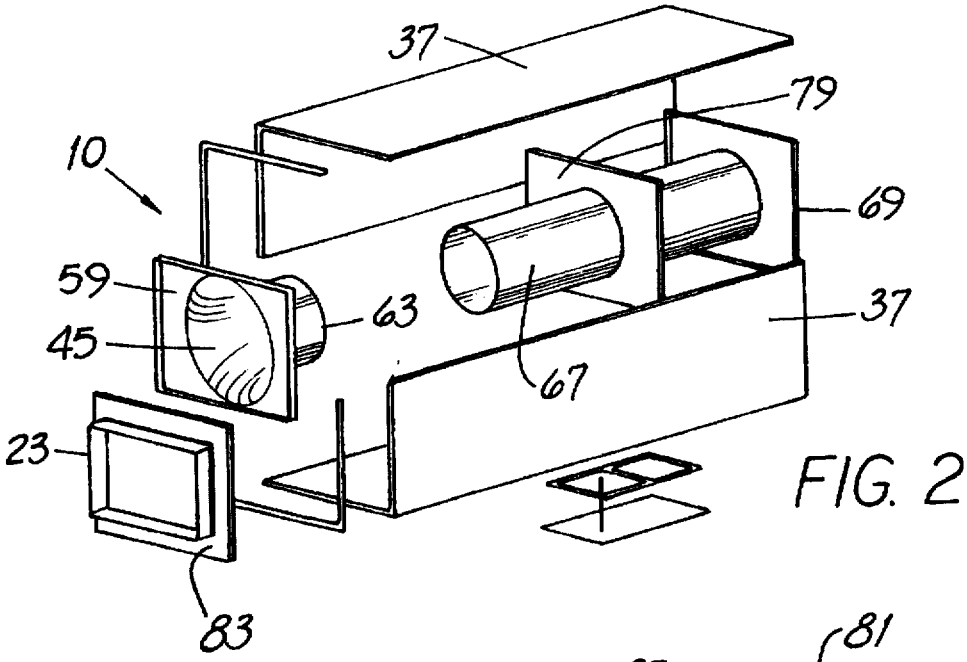
FIG. 2 is an exploded perspective view of the new attenuator.
Figure 11:
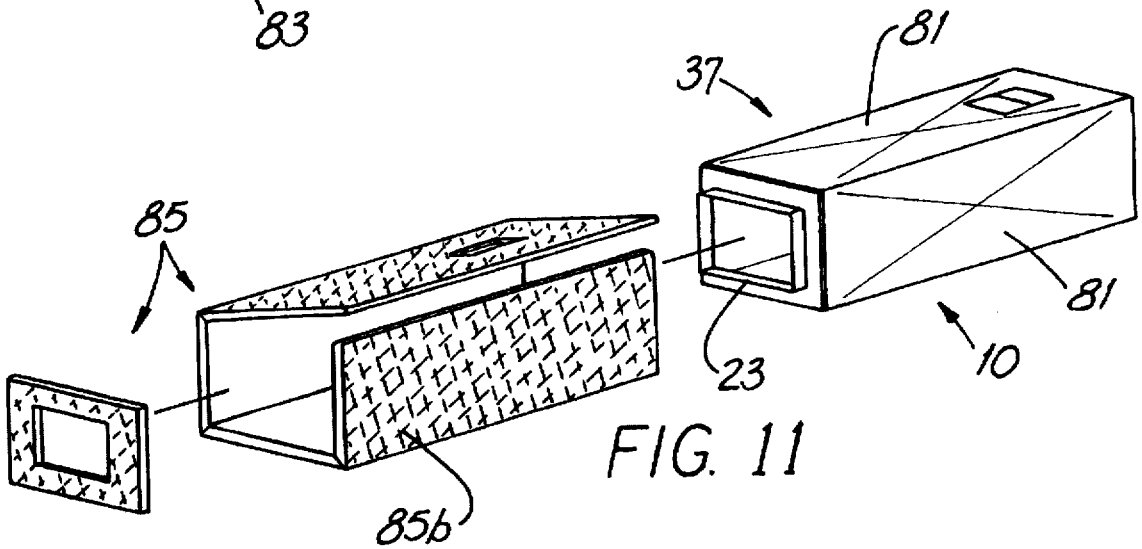
FIG. 11 is an exploded perspective view of the attenuator shown in conjunction with optional external insulation. The attenuator is shown in a position inverted from that of FIG. 2.
Figure 12:
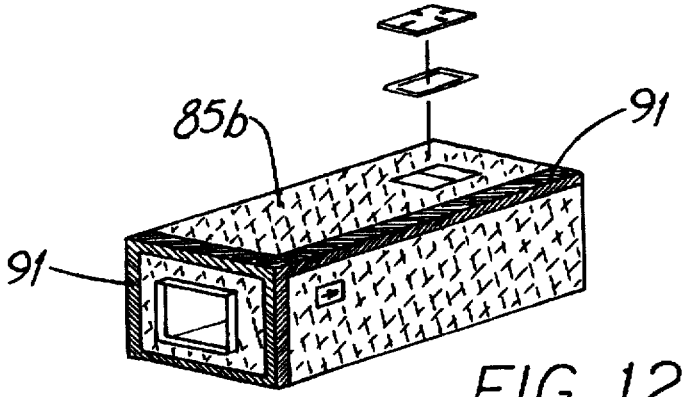
FIG. 12 is a perspective view generally like FIG. 11 except showing the attenuator with external insulation installed.
Figure 3:
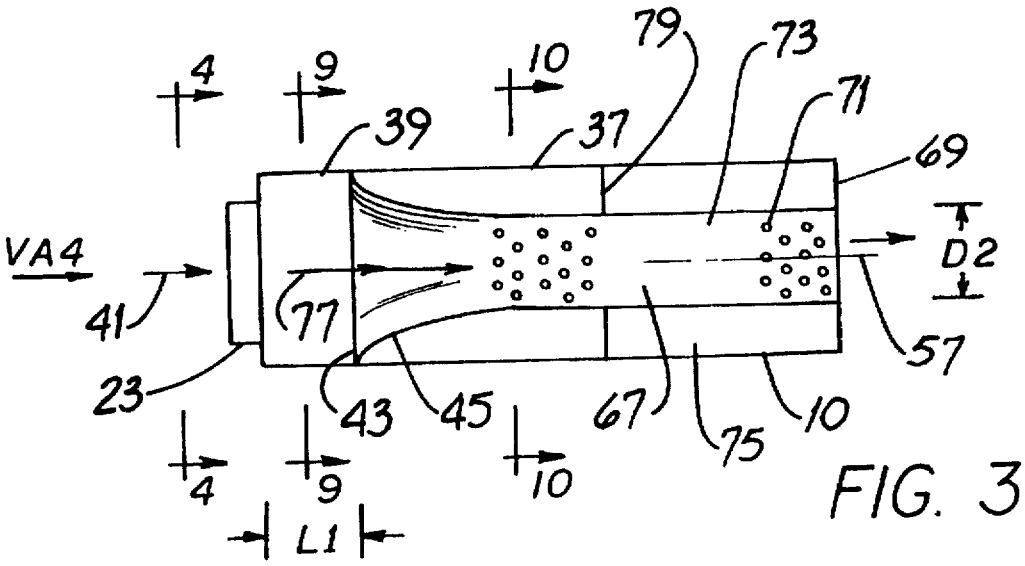
FIG. 3 is a sectional side elevation view of the attenuator of FIG. 2.
Figure 4:
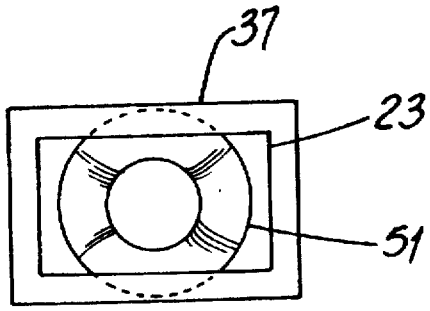
FIG. 4 is a sectional view of the attenuator taken generally along the viewing plane 4—4 of FIG. 3.

Referring also to FIGS. 2, 3 and 4, the new attenuator 10 includes an elongate outer housing 37 which in cross-section is generally rectangular. Such housing 37 has an inlet end 23 which is also rectangular and which circumscribes an area somewhat less than the area circumscribed by the housing 37 as both areas are shown in FIG. 4 and viewed along the viewing axis VA4. While the housing 37 and other components of the attenuator 10 are preferably formed of sheet metal, other rigid sheet-like materials may be used.

Adjacent to the inlet end 23 is an air flow transition chamber 39 which is rectangular in cross-section and "box-like" in general configuration. Such chamber permits air, represented by the arrow 41, which is flowing into the attenuator 10 through the inlet end 23 to "flow-normalize," i.e., to establish a substantially uniform velocity profile before or as such air passes into the adjacent entry portion 43 of the elliptical inlet mouth 45.

Figure 5:
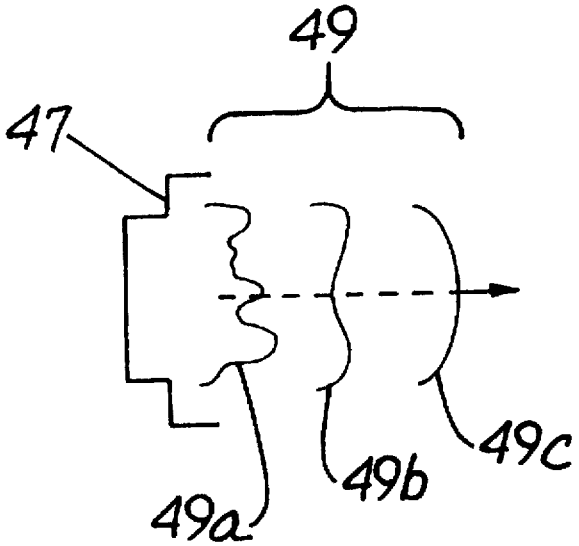
FIG. 5 is a symbolic view representing the principle of air flow normalization.
Figure 7:
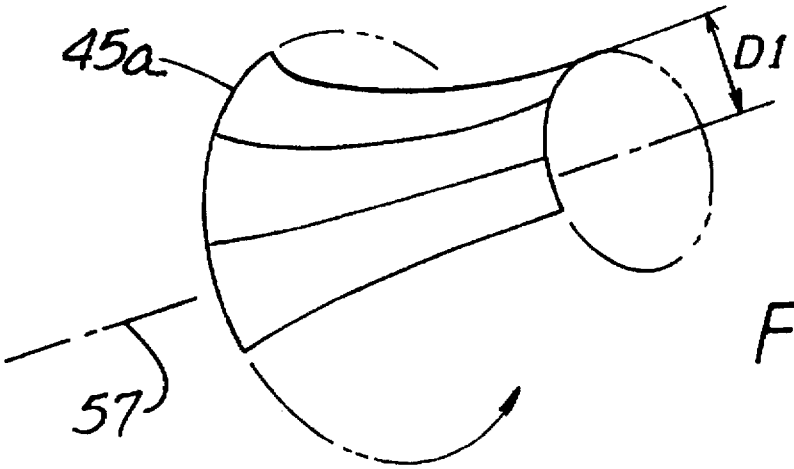
FIG. 7 shows how a surface of revolution is formed by rotating the segment of an ellipse about an axis and at a fixed distance therefrom.

Understanding of the principle of normalization of air flow will be aided by reference to FIG. 5 in which the exemplary velocity profile of air through an inlet 47 is represented by the multi-part curve 49. As such air proceeds along the relatively-short length of the chamber 39, its profile "transitions" generally as represented by the curves **49*a*, 49*b*, 49*c*, in that order. The chamber 39 thereby helps reduce the sound resulting from air flowing through the attenuator 10. As is apparent from FIGS. 2 and 4, the cross-sectional area of the chamber 39 (bounded by housing 37) is somewhat greater than the cross-sectional area of the entry portion 43 bounded by the solid and dashed circle 51 in FIG. 4**.

Referring particularly to FIGS. 2, 3, 6, 7 and 8, the inlet mouth 45 defines a surface of revolution **45*a* formed by rotating a segment 53 of an ellipse 55 about the attenuator long axis 57 and at a fixed distance D1 therefrom. In a highly preferred embodiment, the segment 53 is substantially a quadrant 53*a* of the ellipse 55. (The terms "surface of revolution" and, as applied to an ellipse 55**, a "quadrant" are widely-understood terms from the field of geometry.)

Whether or not such surface of revolution **45*a* is defined by a rotated ellipse quadrant 53*a* or by a rotated ellipse segment 53 (a segment 53 being well less than a full ellipse perimeter and, in the specific case shown in the drawings, somewhat less than a quadrant 53*a*) is a function of the skill of the sheet metal worker who makes the attenuator 10. It is also a function of cost restraints attending the manufacture of the attenuator 10**.

Figure 9:
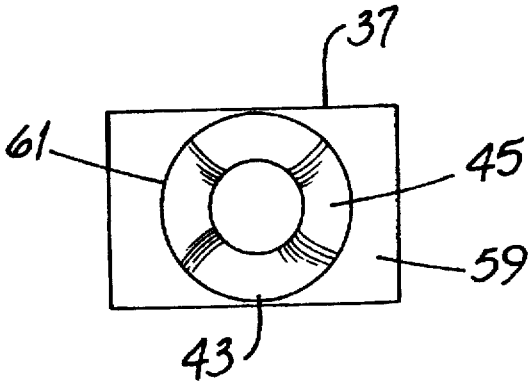
FIG. 9 is a sectional view of the attenuator taken generally along the viewing plane 9—9 of FIG. 3.
Figure 10:
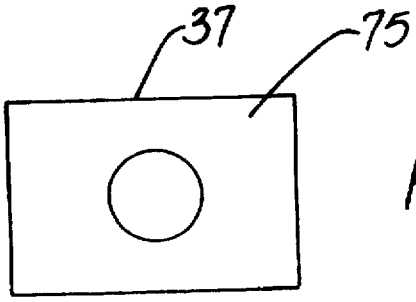
FIG. 10 is a sectional view of the attenuator taken generally along the viewing plane 10—10 of FIG. 3.
Figure 6:
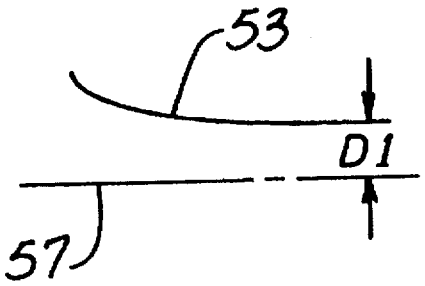
FIG. 6 shows a segment of an ellipse at a fixed distance from an axis and is used to explain the meaning of the phrase "surface of revolution."

If such surface **45*a* is defined by a quadrant 53*a*, the transition from such surface 45*a* to the flat panel 59 between the chamber 39 and the entry portion 43 is smooth. If such surface 45*a* is defined by a segment 53 which is somewhat less than a quadrant 53*a*, a transition "line" 61 such as shown in FIG. 9** will be apparent. But there is little, if any, difference in sound-reducing effectiveness.

Figure 8:
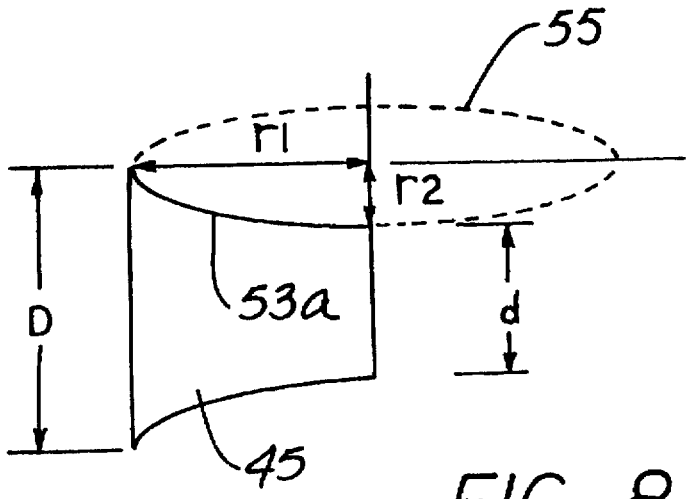
FIG. 8 shows an ellipse and the relationship of a quadrant thereof to the inlet mouth of the new attenuator.

Referring to FIG. 8, in a preferred embodiment, the inlet mouth 45 is configured using the general equation for an ellipse, i.e.,:

$$\left(\frac{x}{r1}\right)^2+\left(\frac{y}{r2}\right)^2=1$$

and the following parameters:

$$Deq=\left(\frac{4\cdot D^2}{\pi}\right)^{0.5}$$

$$B=\frac{d}{Deq}\text{ and equal to or greater than 0.45}$$

$$r1=(0.5)(Deq)$$
$$r2=(0.5)(Deq-d)$$

(International Standards Organization Reference ISO 5221-1984E and American Society of Mechanical Engineers Supp. 19.5 describe so-called long-radius nozzles for use in measuring air flow rate.)

The exit opening 63 of the inlet mouth 45 is connected to and concentric with an elongate, generally-cylindrical tube 67 which extends between such opening 63 and the blank-off plate 69 at the downstream end of the attenuator 10. Such tube 67 is preferably made of sheet metal, has perforations 71 along its length and constitutes an air flow passage 73. In a specific embodiment, the diameter of each perforation 71 is 0.034 inches and the perforation spacing is 0.250 inches on staggered centers. Of the total surface area of the tube 67, that which is "open" (as a result of the perforations ) is about 1.5% of such total surface area. As set forth in the Background of the specification, it is known to mount a straight length of duct between a VAV terminal unit 11 and an attenuator. As understood in traditional practice, such duct should have a length at least 2.5 times the diameter of the duct feeding the VAV terminal unit 11 in order to provide a uniform velocity profile as represented by curve **49*c* in FIG. 5**.

In highly preferred embodiments of the invention (and contrary to recommendations in a paper titled "HVAC DUCT SYSTEM DESIGN" promulgated by Sheet Metal and Air Conditioning Contractors' National Association, Inc.), the ratio of the length L1 of the air flow transition chamber 39 (measured parallel to the attenuator long axis) to the diameter D2 of the attenuator tube 67 is in the range of about 0.40 to about 1.25.

Referring again to FIGS. 1, 2, 3 and 10, the housing 37, the tube 67, the elliptical inlet mouth 45 and the terminating blank-off plate 69 define an elongate cavity 75. The outer perimeter of the cavity 75 is rectangular, the inner perimeter is circular and the cavity is substantially free of packing. In preferred embodiments, the ratio of the volume of the flow pathway 77 (that pathway 77 defined by the transition chamber 39, the elliptical inlet mouth 45 and the tube 67) to the volume of the cavity 75 is less than 1.0. In highly preferred embodiments, such ratio is in the range of 0.75 to 0.85.

Further, the volume of the cavity 75 is greater than the volume of the tube 67. More specifically, the ratio of the volume of the cavity 75 to that of the tube 67 is in the range of about 2.5 to about 4.0.

It has been found that some of the airborne sound in the tube 67 propagates through the perforations 71 and enters the cavity 75. In another aspect of the invention, the attenuator 10 includes a baffle 79 positioned between the entry portion 43 and the plate 69.

Considered laterally, such baffle 79 extends between the tube 67 and the four outer walls of the housing 37 and substantially entirely occludes the cavity 75. Most preferably, the baffle 79 is about midway between the entry portion 43 and the plate 69.

By including such baffle 79 and positioning it as described, the attenuator 10 more effectively reduces sound in the third octave band. (Brief explanations of octave bands and noise criteria are set forth near the end of the specification.)

Referring also to FIGS. 1, 2, 11, 12 and 13, as one of its optional features, the exterior surfaces 81 of the housing 37, i.e., those surfaces generally parallel to the long axis 57 and that surface 83 at the inlet end 23, are substantially covered by insulation 85. In operating environments where moisture condensation may be a problem, such insulation 85 substantially avoids condensation of moisture on the exterior surfaces 81 and 83. Sound is also thereby reduced.

When the attenuator 10 is used in combination with a VAV terminal unit 11 as shown in FIG. 1 (a typical mode of use), the outlet end 21 of such unit 11 is coupled to the inlet end 23 of the attenuator 10 and flows air into such attenuator 10. Like the attenuator 10, the terminal unit 11 also has exterior surfaces 87, major portions of which are covered by insulation 85. In such combination, the attenuator 10 reduces sound propagated in the air flowing from the unit 11 and the insulation 85 likewise helps avoid moisture condensation and quiets the combination.

Figure 13:
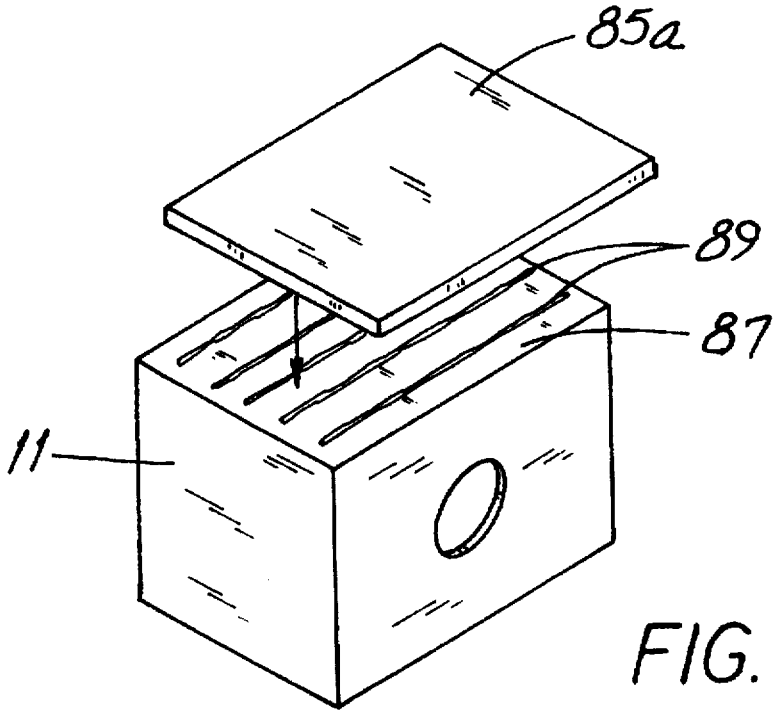
FIG. 13 is an exploded perspective view showing a way to attach insulation to the attenuator or to a VAV terminal unit.

As shown in FIG. 13, one way to insulate the terminal unit 11 and/or the attenuator 10 is by affixing insulating slabs **85*a* to the outer surfaces 87 using, e.g., beads of glue 89. Or, most preferably, reinforced foil scrim kraft faced board 85*b* (of the type shown in FIGS. 11 and 12) is affixed (with foil outward) by laying down heat-activated duct tape 91. It has been found helpful to hold the board 85*b* in place using conventional duct tape (Kendall Corp., Polyken Div., Boston, Mass.) while the heat-activated tape 91 is being applied. One type of preferred board 85*b* is Manville SPIN-GLAS® board and a suitable tape 91** is Fortifiber Corporation's THERMO-LOCK heat-activated tape which is applied with an iron at 500° F.–600° F.

But whatever type of insulation 85 is used, it is preferred that it expose a soft outer surface rather than a hard, rigid surface. Foam-type insulating slabs **85*a* and the Manville board 85*b* noted above have such outer surfaces; sheet metal and rigid plastic sheet have hard, rigid surfaces. (Insulation 85** with a soft outer surface provides a degree of padding protection during shipping.)

The following table defines frequency octave bands 1–8, i.e., those chiefly of concern to designers of HVAC attenuators. Suppression of sound and noise in such octave bands is important since, as a general proposition, the human ear is more sensitive to sounds at those frequencies than to sounds at higher frequencies.

FREQUENCY OCTAVE BANDS

| Band Number | Frequency Range, Hz | Center Frequency, Hz |
|---|---|---|
| 1 | 44–88 | 63 |
| 2 | 88–175 | 125 |
| 3 | 175–350 | 250 |
| 4 | 350–700 | 500 |
| 5 | 700–1400 | 1000 |
| 6 | 1400–2800 | 2000 |
| 7 | 2800–5600 | 4000 |
| 8 | 5600–11200 | 8000 |

Figure 14:
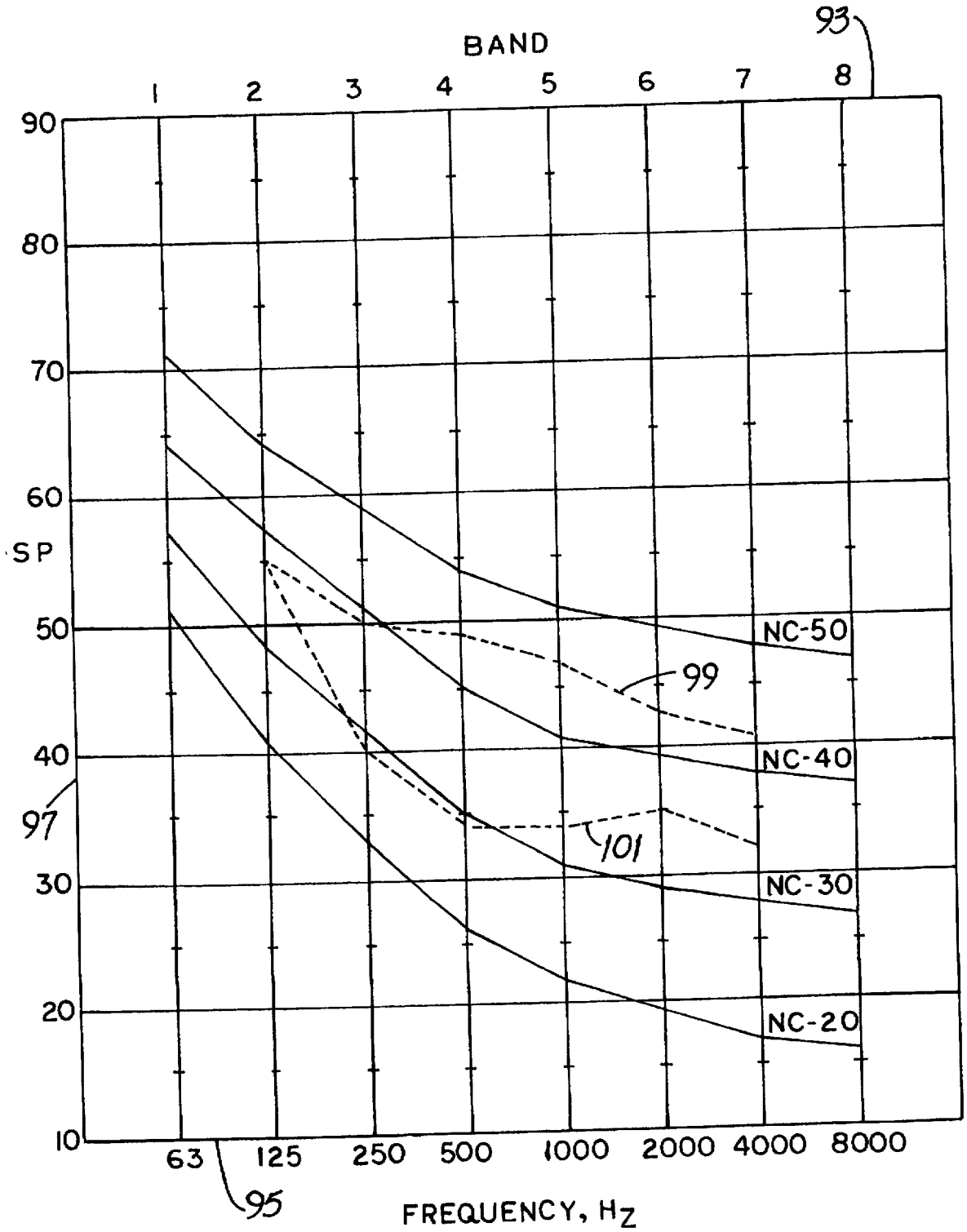
FIG. 14 is a graphic depiction of sound power, octave bands and their center frequencies and noise-criteria curves promulgated by the American Society of Heating, Refrigerating and Air Conditioning Engineers. The performance of the new attenuator is represented by the dashed line.

In its 1993 ASHRAE Handbook (and perhaps others), the American Society of Heating, Refrigerating and Air-Conditioning Engineers promulgates information regarding noise criteria (NC) curves. FIG. 14 shows, in somewhat simplified form, noise criteria curves NC20, NC30, NC40 and NC50. The upper horizontal axis 93 represents the octave band, the lower horizontal axis 95 represents the band center frequencies in Hertz and the left vertical axis 97 represents octave band sound pressure (SP) level (dB re 20 micro Pa).

Such curves are used to define the limits that the octave-band spectrum of a noise source must not exceed to achieve a level of occupant acceptance. For example, an NC-35 design goal is commonly used for private offices; the background noise level meets this goal provided no portion of its spectrum lies above the NC-35 curve.

To illustrate the superiority of the invention, the dashed line 99 in FIG. 14 represents the characteristics of a terminal unit 11 without an attenuator 10 and the dashed line 101 represents the characteristics of a combination including the same terminal unit 11 coupled to an attenuator 10. As the line 101 indicates, the combination exhibits NC parameters of about NC-36, NC-28, NC-28, NC-33, NC-36 and NC-34 at the center frequencies of octave bands 2 through 7, respectively. In industry practice, the combination would be listed as an "NC-36" product since NC-36 is the maximum noise criteria figure at any of the octave bands 2 through 7.

While the principles of this invention have been shown and described in connection with specific preferred embodiments, it is to be understood clearly that such embodiments are exemplary and not limiting.

What is claimed:

1. In an apparatus for attenuating sound in a HVAC system and having (a) an inlet mouth, (b) an air flow passage downstream of the inlet mouth, (c) an apparatus length, and a long axis extending along the length, the improvement wherein:

the apparatus includes an inlet end;

the inlet mouth is in downstream air flow relationship to the inlet end and defines a surface of revolution formed by rotating a segment of an ellipse about the long axis and at a fixed distance therefrom;

the inlet mouth has an entry portion and an exit opening and converges in a downstream air flow direction from the entry portion to the exit opening.

2. The apparatus of claim 1 wherein:

the inlet mouth includes an entry portion having a cross-sectional area;

the apparatus includes an air flow transition chamber in upstream air flow relationship to the inlet mouth and to the entry portion and in downstream air flow relationship to the inlet end;

the transition chamber has a cross-sectional area; and the cross-sectional area of the transition chamber is greater than the cross-sectional area of the entry portion.

3. The apparatus of claim 2 wherein the cross-sectional area of the transition chamber is substantially rectangular.

4. The apparatus of claim 1 wherein:

the apparatus includes an outlet end in downstream air flow relationship to the inlet end; and the apparatus includes a baffle between the inlet mouth and the outlet end.

5. The apparatus of claim 4 wherein the sound being attenuated includes a third octave band and the baffle is about midway between the entry portion and the outlet end, whereby the apparatus more effectively attenuates sound in the third octave band.

6. The apparatus of claim 4 including a housing extending from the entry portion to the outlet end and a tube in the housing and wherein:

the housing and the tube have an elongate cavity therebetween; and the baffle occludes the cavity.

7. The apparatus of claim 6 wherein the sound being attenuated includes a third octave band and the baffle is about midway between the entry portion and the outlet end, whereby the apparatus more effectively attenuates sound in the third octave band.

8. The apparatus of claim 6 wherein the cavity is free of packing.

9. The apparatus of claim 1 including a housing around the inlet mouth and having a plurality of exterior surfaces generally parallel to the long axis and wherein the exterior surfaces are substantially covered by insulation, whereby condensation of moisture on the exterior surfaces is substantially avoided.

10. The apparatus of claim 1 including a housing around the air flow passage and around the inlet mouth and wherein:

the air flow passage is through a tube;

the housing is around the tube;

the apparatus includes an air flow transition chamber in downstream flow relationship to the inlet end and having a chamber length;

the tube is generally cylindrical and has a diameter; and the ratio of the chamber length to the tube diameter is about 0.40 to about 1.25.

11. The apparatus of claim 10 wherein:

the inlet mouth includes an entry portion; and the transition chamber is adjacent to the entry portion and is in an upstream air flow relationship to the inlet mouth.

12. The apparatus of claim 1 including a housing and a tube in the housing and wherein:

the housing is around the tube and around the inlet mouth;

the housing and the tube have an elongate cavity therebetween;

the cavity has a volume and the tube has a volume; and the volume of the cavity is greater than the volume of the tube.

13. The apparatus of claim 12 wherein the ratio of the volume of the cavity to the volume of the tube is in the range of about 2.5 to about 4.0.

14. In combination, a variable air volume terminal unit and an apparatus for attenuating sound propagated by air flowing from the unit and wherein:

the apparatus has a length and a long axis extending along the length;

the apparatus includes an inlet end, a transition chamber, an inlet mouth and a tube;

the inlet mouth defines a surface of revolution formed by rotating a segment of an ellipse about the long axis and at a fixed distance therefrom;

the transition chamber is in downstream air flow relationship to the inlet end;

the inlet mouth is in downstream air flow relationship to the transition chamber;

the tube is in downstream air flow relationship to the inlet mouth;

the terminal unit has an outlet end coupled to the inlet end for flowing air into the apparatus; and the terminal unit and the apparatus each have exterior surfaces, major portions of which are covered by insulation.

15. The combination of claim 14 wherein the transition chamber has a cross-sectional area which is substantially rectangular.

16. The combination of claim 15 wherein:

the tube terminates in a tube outlet end;

the inlet mouth includes an entry portion;

the apparatus includes a baffle about midway between the entry portion and the outlet end; and the apparatus has a housing around the inlet mouth, the entry portion, the tube and the baffle.

17. The combination of claim 16 wherein the apparatus exterior surfaces are housing exterior surfaces extending from the entry portion to the outlet end and wherein:

the housing and the tube have an elongate cavity therebetween; and the baffle occludes the cavity.

18. In an apparatus for attenuating sound in a HVAC system and having (a) an inlet mouth, (b) an air flow passage downstream of the inlet mouth, (c) an apparatus length, and (d) a long axis extending along the length, the improvement wherein:

the apparatus includes an inlet end;

the inlet mouth is in downstream air flow relationship to the inlet end and defines a surface of revolution formed by rotating a segment of an ellipse about the long axis and at a fixed distance therefrom;

the inlet mouth includes an entry portion having a cross-sectional area;

the apparatus includes an air flow transition chamber in upstream air flow relationship to the inlet mouth and to the entry portion and in downstream air flow relationship to the inlet end;

the transition chamber has a cross-sectional area; and the cross-sectional area of the transition chamber is greater than the cross-sectional area of the entry portion.

19. In an apparatus for attenuating sound in a HVAC system and having (a) an inlet mouth, (b) an air flow passage downstream of the inlet mouth, (c) an apparatus length, and (d) a long axis extending along the length, the improvement wherein:

the apparatus includes an inlet end and an outlet end in downstream air flow relationship to the inlet end;

the inlet mouth is in downstream air flow relationship to the inlet end and defines a surface of revolution formed by rotating a segment of an ellipse about the long axis and at a fixed distance therefrom; and the apparatus includes a baffle between the inlet mouth and the outlet end.

20. In an apparatus for attenuating sound in a HVAC system and having (a) an inlet mouth, (b) an air flow passage downstream of the inlet mouth, (c) an apparatus length, and (d) a long axis extending along the length, the improvement wherein:

the apparatus includes an inlet end and a housing around the inlet mouth;

the inlet mouth is in downstream air flow relationship to the inlet end and defines a surface of revolution formed by rotating a segment of an ellipse about the long axis and at a fixed distance therefrom;

the housing has a plurality of exterior surfaces generally parallel to the long axis and wherein the exterior surfaces are substantially covered by insulation, whereby condensation of moisture on the exterior surfaces is substantially avoided.

21. In an apparatus for attenuating sound in a HVAC system and having (a) an inlet mouth, (b) an air flow passage downstream of the inlet mouth, (c) an apparatus length, and (d) a long axis extending along the length, the improvement wherein:

the apparatus includes an inlet end;

the inlet mouth is in downstream air flow relationship to the inlet end and defines a surface of revolution formed by rotating a segment of an ellipse about the long axis and at a fixed distance therefrom;

the apparatus has a housing around the air flow passage and around the inlet mouth:

the air flow passage is through a tube;

the housing is around the tube;

the apparatus includes an air flow transition chamber in downstream flow relationship to the inlet end and having a chamber length;

the tube is generally cylindrical and has a diameter; and the ratio of the chamber length to the tube diameter is about 0.40 to about 1.25.

22. In an apparatus for attenuating sound in a HVAC system and having (a) an inlet mouth, (b) an air flow passage downstream of the inlet mouth, (c) an apparatus length, and (d) a long axis extending along the length, the improvement wherein:

the apparatus includes an inlet end, a housing around the tube and around the inlet mouth;

the inlet mouth is in downstream air flow relationship to the inlet end and defines a surface of revolution formed by rotating a segment of an ellipse about the long axis and at a fixed distance therefrom;

the housing and the tube have an elongate cavity therebetween;

the cavity has a volume and the tube has a volume; and the volume of the cavity is greater than the volume of the tube.

* * * * *